United States Patent [19]

Boelens

[11] Patent Number: 4,570,281

[45] Date of Patent: Feb. 18, 1986

[54] ROTARY DRAIN CLEANER

[76] Inventor: David A. Boelens, 2805 N.E. 117th Ave., Portland, Oreg. 97201

[21] Appl. No.: 592,024

[22] Filed: Mar. 22, 1984

[51] Int. Cl.[4] ..... B08B 9/02

[52] U.S. Cl. ..... 15/104.3 SN

[58] Field of Search ..... 15/104.3 R, 104.3 SN; 242/54; 254/134.3; 226/143

[56] References Cited

U.S. PATENT DOCUMENTS

| | | | |
|---|---|---|---|
| 2,111,527 | 3/1938 | Blanc | 15/104.3 SN |
| 2,267,493 | 12/1941 | Clotz | 15/104.3 SN |
| 2,318,172 | 5/1943 | Long | 15/104.3 SN |
| 2,953,799 | 9/1960 | Arnold | 15/104.3 SN |
| 2,955,307 | 10/1960 | Hunt | 15/104.3 SN |
| 3,095,592 | 7/1963 | Hunt | 15/104.3 SN |
| 3,298,051 | 1/1967 | Ratliff | 15/104.3 SN |
| 3,605,158 | 9/1971 | Russell | 15/104.3 SN |
| 3,608,122 | 9/1971 | Ratliff | 15/104.3 SN |
| 3,673,627 | 4/1972 | Caperton | 15/104.3 SN |
| 3,742,548 | 7/1973 | Ciaccio | 15/104.3 SN |

*Primary Examiner*—Edward L. Roberts

*Attorney, Agent, or Firm*—Eugene D. Farley

[57] ABSTRACT

A rotary drain cleaner adapted to mount and operate a plumber's snake. The cleaner comprises a frame, front and back bearings supported on the frame, and a telescoping, segmented, motor-driven shaft supported on the bearings. The shaft includes a front axle segment journaled in the front bearing, a freely rotatable guide segment for guiding a plumber's snake, a drum-supporting segment, and on the drum-supporting segment a rear axle journaled in the rear bearing. A cage is fixed to the front axle segment. A drum is fixed to the drum-supporting segment and the cage for mounting a plumber's snake. All of the elements of the frame and shaft may advantageously comprise interfitted segments of plastic pipe and plastic pipe fittings.

5 Claims, 4 Drawing Figures

ROTARY DRAIN CLEANER

BACKGROUND AND SUMMARY OF THE INVENTION

This invention relates to rotary drain cleaners. It pertains particularly to rotary drain cleaners of the class designed to mount and operate a device commonly termed a "plumber's snake".

It is the general purpose of the present invention to provide a power-operated, rotary drain cleaner which may be fabricated from a plurality of interfitted plastic pipe parts including pipe lengths, T's and elbows, and which accordingly may be produced at about one-third the cost of the conventional rotary drain cleaner. It thus may be made widely available to the average householder or apartment owner.

It is a further purpose of the present invention to provide a rotary drain cleaner of the class described which is simple in construction, light in weight, easily disassembled, easily serviced and cleaned, durable, adapted for the mounting and use of easily interchangeable plumber's snake units, and efficient in operation.

These and other objects of the invention are achieved by the provision of a rotary drain cleaner which comprises a frame mounting front and back bearings. A telescoping, segmented shaft is supported in the bearings. Both frame and shaft may be fabricated from standard units of plastic pipe.

The shaft comprises a front axle segment journaled in the front bearing, a freely rotatable guide segment for guiding a plumber's snake, a drum-supporting segment, and on the drum-supporting segment a rear axle journaled in the rear bearing.

A cage is fixed to the front axle segment. A drum fixed to both the drum-supporting segment and cage lies within the latter and is adapted to mount a coiled plumber's snake. A motor connected to the shaft rotates the shaft, and hence the snake, at a predetermined operating speed.

THE DRAWINGS

In the drawings

DESCRIPTION OF A SPECIFIC EMBODIMENT OF THE INVENTION

Figure 1:
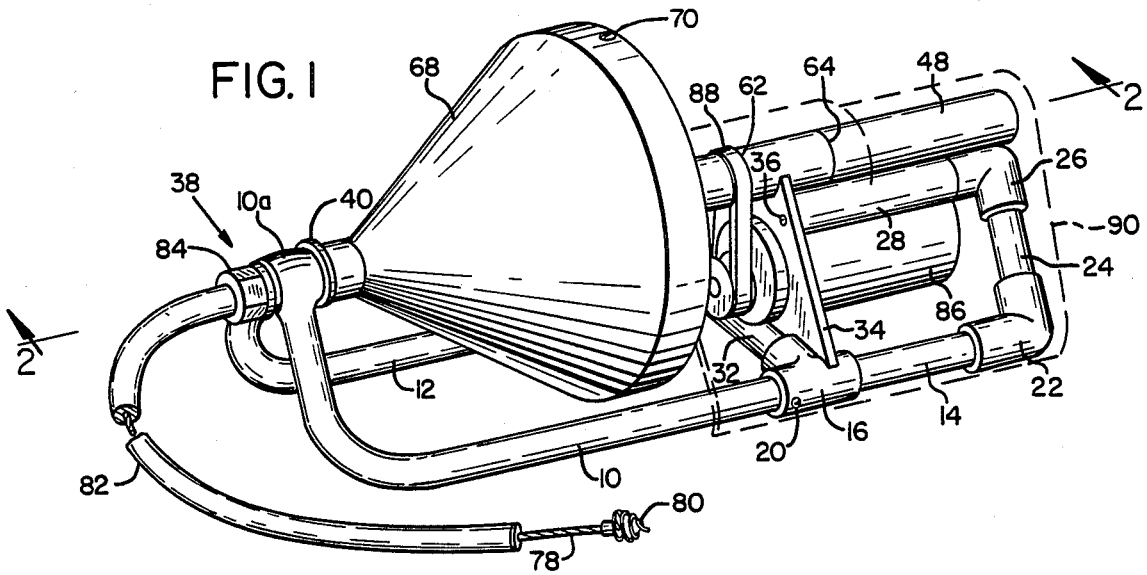
FIG. 1 is a perspective view of the hereindescribed rotary drain cleaner.

As shown particularly in FIG. 1, the rotary drain cleaner of my invention includes a boat-shaped frame which is disassemblable and triangular in cross section. It consists basically of a pair of parallel, laterally spaced runners having forward and rearward upward extensions which angle inwardly and meet at their upper ends.

For convenience of assembly and disassembly, the runners are in two sections.

The forward section comprises a pair of base pieces 10, 12 bent upwardly and angularly toward each other. Preferably, they comprise a single continuous length of plastic pipe shaped in the illustrated manner, with the underside of the reversely bent upper, or connecting, portion cut away to form a strap-like link **10*a*** which receives the front bearing of the assembly, as will appear hereinafter.

Front base pieces 10, 12 are coupled to axially aligned back base pieces, one of which is indicated at 14, by means of T's 16, 18. Bolts 20 releasably secure the structured elements of the base.

Back base pieces 14 are coupled by means of elbows 22 to vertical frame pieces 24. As noted above, these are angled upwardly and inwardly toward each other into substantially meeting engagement at their upper ends.

The upper ends of vertical frame pieces 24 mount inwardly directed elbows 26 which, in turn, mount elevated, horizontally-disposed frame pieces 28, 30. These provide inwardly-extending, immediately adjacent, parallel, support arms.

A cross base piece 32 interconnects T's 16, 18.

The frame is further stiffened and strengthened by means of a transversely arranged, vertical, support plate 34. This is received in notches in the upper surfaces of T's 16, 18 and is fastened to inwardly extending arms 28, 30 by suitable means, as by means of screws 36.

All of these elements of the frame assembly preferably comprise lengths of standard plastic pipe and standard pipe fittings, bolted or adherently united to each other by means of conventional glues for such components.

The separable frame thus provided mounts spaced, aligned bearing assemblies. The front bearing assembly is indicated generally at 38, FIG. 2.

It comprises a nipple 40 which receives a tri-functional, stepped sleeve. The sleeve has a bearing section 42, an abutment section 44, which serves both axle-locating and snake-guiding functions, and an outwardly-projecting threaded end 46. Nipple 40 may comprise a standard plastic pipe fitting, while the other parts of the bearing assembly may comprise a pair of pipe lengths partially telescoped and glued together to form the indicated stepped configuration.

The rearward bearing assembly comprises merely a length of pipe, preferably plastic pipe, indicated at 48. It nests between adjacent, parallel arms 28, 30 to which it may be secured by means of conventional plastic pipe adhesives.

A telescoping, segmented shaft is supported in bearings 38, 48. It comprises a front axle segment journaled in front bearing 38, a freely rotatable snake guide segment for guiding a plumber's snake, a drum-supporting segment for feeding and operating the snake, and a rear axle segment journaled in rear bearing 48.

Figure 2:
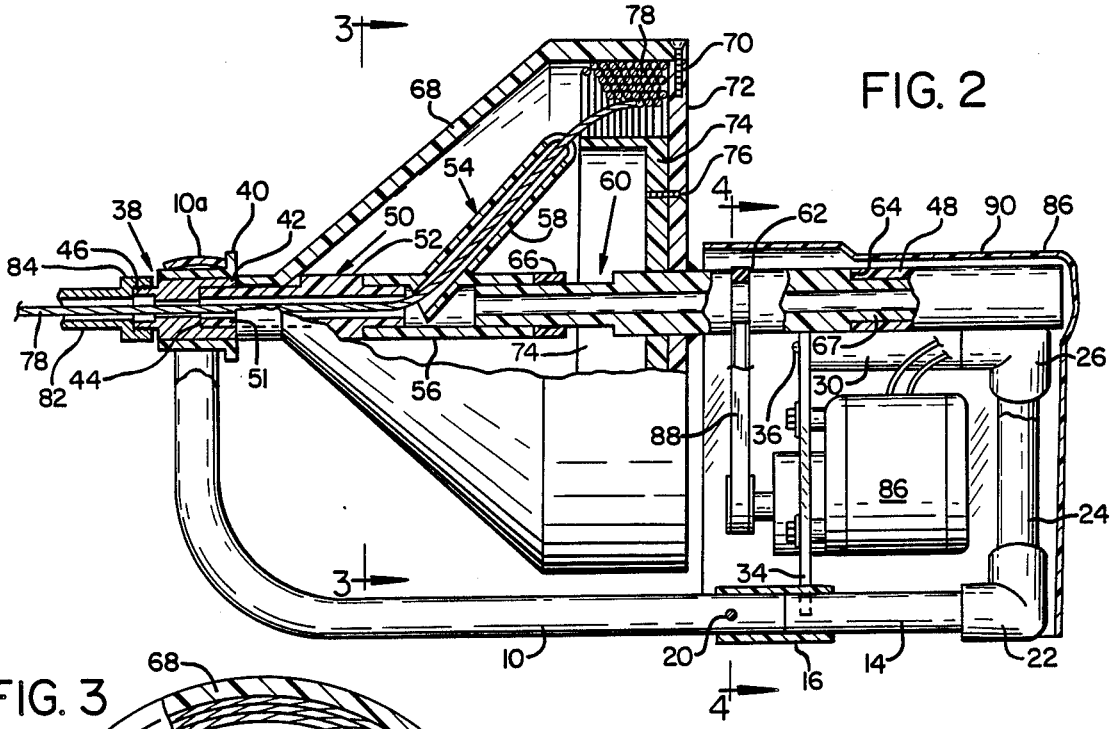
FIG. 2 is a side elevation, partly in longitudinal section, of the drain cleaner, the section being taken along line 2—2 of FIG. 1.
Figure 3:
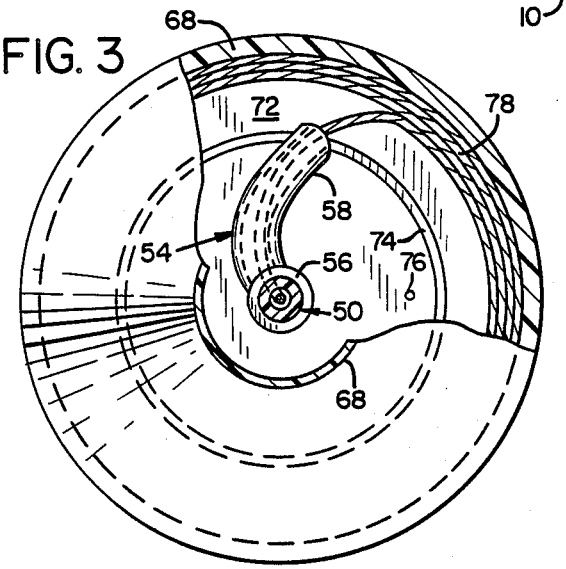
FIG. 3 is a transverse section taken along line 3—3 of FIG. 2, with parts being broken away better to show the interior construction.
Figure 4:
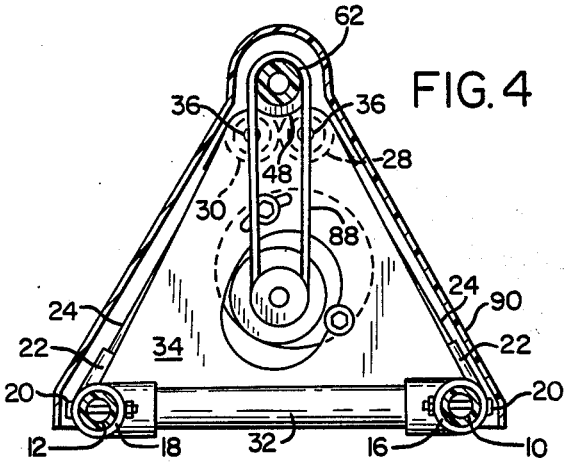
FIG. 4 is a transverse section taken along line 4—4 of FIG. 2.

The front axle segment is indicated generally at 50, FIG. 2. It has an externally stepped configuration and preferably is made by telescoping short and long lengths of plastic pipe and glueing them together. The forward end of this unit provides an axle 51 which is journaled in bearing 42. The enlarged central portion 52 serves as an external stop or abutment.

Telescoped over front axle segment 52 and located by abutment 52 is a freely rotatable, or floating, snake guide segment 54. This has for its function guiding the plumber's snake as it is operated by the apparatus.

It comprises a length of pipe, preferably plastic pipe, 56 which telescopes over the rearward end of front axle segment 50, and an outwardly and angularly extending insert 58. Both of these elements of the assembly may be lengths of plastic pipe, fitted and glued together.

The forward end of a shaft drum-supporting segment, indicated generally at 60, telescopes into the rearward end of snake guide segment 54. As is the case with the previously described shaft segments, the drum-support segment may comprise lengths of plastic pipe telescoped over each other and glued together. The outer two lengths of pipe are spaced apart from each other to form an indentation or groove which provides an integral pulley 62 for the shaft. The rearward shoulder provides an abutment 64.

A sleeve 66 is mounted on the forward end of drum-supporting segment 60. Initially, it is free fitting. However, in the assembly of the shaft it is placed in abutment with the rearward end of freely rotatable snake guide 54. In this position it is glued to the forward end of drum-support segment 60, thereby locating the snake guide in its operative position on the shaft.

The rearward end 67 of drum-supporting segment 60 serves as an axle. It is journaled in rear bearing 48.

The telescoping shaft assembly thus forms an integrated unit which serves the triple functions of providing a drive, providing a guide for the snake, and providing a support for the drum mounting the snake and the cage enclosing the same.

The construction of the drum and cage assembly also is illustrated particularly in FIG. 2.

The cage 68 comprises a funnel-shaped case which in fact may comprise a conventional plastic funnel. Its forward restricted end is glued or otherwise affixed to the forward end of front axle 50. Its rearward or enlarged end is bolted by means of bolts 70 to a radially extending plate 72 which is mounted on and glued to a central portion of drum-supporting segment 60.

Drum 74 is bolted by means of bolts 76 to plate 72, centrally thereof. It supports a conventional plumber's snake 78 having on its outer end an auger 80 and provided also with an external operating sleeve 82 fitted with an inner coupling 84 which couples the sleeve to threaded end 46 of bearing unit 42. Drum 74 may comprise a length of standard, large diameter plastic pipe glued to a circular piece of sheet plastic.

A reversible motor 86 drives the unit through a belt-pulley-belt tightener assembly 88 which engages integral pulley 62 on drum-supporting segment 60.

A removable case 90 encloses the drive unit.

OPERATION

The operation of the hereindescribed rotary drain cleaner is as follows:

The frame of the unit is disassembled for loading by removing bolts 20 and separating base pieces 10, 12 from the rest of the unit. Cage 68 is removed.

Plumber's snake 78 is mounted on drum 74 in the usual manner. Its free end, with auger 80 removed, is threaded through freely rotatable snake guide 54, hollow front axle 50, front bearing assembly 38 and sleeve 82. Auger 80 is attached.

To use the tool, reversible motor 86 is started, whereupon the associated belt and pulley drive 88 drives drum-support shaft segment 60 through integral pulley 62.

Shaft segment 60 drives plate 72 of cage 68, as well as drum 74. Since the cage 68 is fixed to front axle 50, the latter also is driven.

The entire segmented shaft-drum-snake-cage-assembly thus is rotated at a speed determined by the speed of motor 86. The rotating snake 78 then is fed by hand into the drain to be cleaned, in the usual manner.

Having thus described my invention in preferred embodiments, I claim:

1. A rotary drain cleaner comprising:

(a) a frame having front and rear ends, (b) front and rear spaced bearings supported on the frame, (c) a telescoping, segmented shaft supported on the bearings, the shaft comprising:

(1) a front axle segment journaled in the front bearing and having an axial bore therethrough, (2) behind the front axle segment a freely rotatable guide segment for guiding a plumber's snake, the guide segment comprising a hollow tubular member telescopically coupled freely at its front end to the front axle segment, and an angularly extending hollow snake guide secured to and communicating with the hollow tubular member intermediate the ends of the latter, (3) behind the guide segment a drum-supporting segment telescopically coupled freely at its front end to the rear end of the hollow tubular member of the guide segment, (4) on the drum-supporting segment a rear axle journaled in the rear bearing, (d) a cage fixed at its front end to the front axle segment and at its rear end to the drum-supporting segment of the shaft, (e) a drum within the cage fixed to the drum-supporting segment and the cage and defining a restricted annular space between the cage and drum in which to confine a coiled plumber's snake, and (f) a motor connected to the drum-supporting segment of the shaft for rotating the drum-supporting segment and the front axle segment.

2. The rotary drain cleaner of claim 1 wherein the cage is funnel shaped and disposed with the small diameter end secured to the front axle segment and the large diameter end overlying the drum.

3. The rotary drain cleaner of claim 1 wherein the frame is a boat-shaped frame, triangular in cross section and having a pair of adjacent, inwardly extending arms at the apex of its rearward portion, and a pipe length nested between the arms and serving as the rear bearing.

4. The rotary drain cleaner of claim 1 wherein the frame includes a pair of laterally spaced, longitudinally extending front tubular members having front ends converging upwardly and secured to the front bearing and forming a front frame section, and a pair of laterally spaced longitudinally extending rear tubular members having rear ends converging upwardly and secured to the rear bearing and forming a rear frame section, and coupling means releasably interconnecting the front and rear tubular members, whereby to allow separation of the frame sections at the coupling means and the shaft at the rear bearing.

5. The rotary drain cleaner of claim 4 wherein the motor is mounted on the rear frame section.

* * * * *